US006171473B1

(12) United States Patent
Fornoff

(10) Patent No.: US 6,171,473 B1
(45) Date of Patent: Jan. 9, 2001

(54) INTEGRATED RESIDUE THERMAL CRACKING AND PARTIAL OXIDATION PROCESS

(75) Inventor: Louis L. Fornoff, Cedar Grove, NJ (US)

(73) Assignee: ABB Lummus Global Inc., Bloomfield, NJ (US)

( * ) Notice: Under 35 U.S.C. 154(b), the term of this patent shall be extended for 0 days.

(21) Appl. No.: 09/288,199

(22) Filed: Apr. 8, 1999

(51) Int. Cl.[7] ..... C10G 9/00

(52) U.S. Cl. ..... 208/106; 67/950; 67/96; 67/81; 67/82

(58) Field of Search ..... 208/106–108, 208/67, 96, 950, 309

(56) References Cited

U.S. PATENT DOCUMENTS 4,938,862 * 7/1990 Vissor et al. ..... 208/67

* cited by examiner

*Primary Examiner*—Helane E. Myers
(74) *Attorney, Agent, or Firm*—Alix, Yale & Ristas, LLP

(57) ABSTRACT

A residue from petroleum refining is thermally cracked to convert the residue to useful cracked products and to generate fuel gas. The residue is cracked by contact with hot synthesis gas produced by the gasification on the tar/pitch residue remaining after the cracking of the residue feed. Waste heat can be recovered from remaining portions of the synthesis gas from the gasifier in the form of steam which can be used in the gasification process and in the cracking process as needed for coke suppression. The combustible synthesis gas and the combustible gasses form the thermal cracking are separated from the cracked product liquid and used for power generation in a combined cycle plant.

9 Claims, 2 Drawing Sheets

INTEGRATED RESIDUE THERMAL CRACKING AND PARTIAL OXIDATION PROCESS

BACKGROUND OF THE INVENTION

The invention relates to a process for treating the petroleum residue from a refinery by an integrated process of thermal cracking and partial oxidation to obtain higher thermal cracking at reduced investment cost.

The residue from a refinery usually comprises the components boiling above about 500–575° C. These residues may comprise any such streams such as vacuum tower residue, visbreaker residue and deasphalting residue. There is a considerable amount of residue from a refinery to be treated. For example, a typical refinery processing 10 million metric tons annually (MTA) of Arabian Mix Crude will produce about 6,500–7,000 MT per stream day (SD) of vacuum tower residue. This residue can be blended into residual fuel oil (which has a low value), upgraded to high value transportation fuels (which is expensive) or gasified to produce power. Without further processing, gasification of this residue will provide about 1,200 MW of electrical power. This is greatly in excess of the amount of power which can be effectively used in the plant. Several processes are available to reduce the amount of the residue but the degree of conversion of the residue is low and/or the cost is high. Examples are:

| Process | Wt % Unconverted Residue or Coke Formed | Cost of Upgrading Plant $ MM |
|---|---|---|
| Visbreaking | 84.5% | $29.7 |
| Visbreaking & Vacuum Flasher | 66.5% | $38.6 |
| Deasphalting | 43.2% | $46.0 |
| Delayed Coking | 32.5% | $144.3 |

Conversions of more than 50% are desired for efficient and effective plant operation but the cost for obtaining such conversions with these prior art processes is high. With respect to visbreaking, the overall conversion to 500° C. and lighter components is limited to 35% in order to maintain the stability of the residue (500° C.+components) for fuel oil blending. Also, the visbreaking process is limited by the maximum skin temperature of the furnace tubes of about 650° C. Although higher yields are possible with visbreaking, the unstable nature of the fuel product and the coking of the tubes pose significant problems. Although the Eureka Process (steam cracking with superheated steam) has a good conversion (67%), it requires the injection of superheated steam to suppress coking which all has to be condensed in a downstream fractionator and then treated in a sour water stripping unit. This adds cost to the unit.

SUMMARY OF THE INVENTION

The present invention involves the thermal cracking of a residue from petroleum refining to convert the residue at low cost to useful cracked products at a high conversion yield and to generate fuel gas for power production without the need for supplying outside energy for the thermal cracking.

The present invention involves thermal cracking of a residue from petroleum refining by contacting the residue feed with hot synthesis gas produced by gasification of the tar/pitch residue remaining after the cracking of the feed. Only a portion of the hot synthesis gas produced via gasification is needed for thermal cracking. Waste heat is recovered in the form of steam from the remaining synthesis gas from the gasifier and a portion of the steam can be used in the gasification process. The cooled, combustible synthesis gas is combined with the combustible gases produced by the thermal cracking for power generation such as in a combined cycle power plant. The cracked liquid converted from the residue feed is similar to thermal products from delayed coking and visbreaking and is hydrotreated in the same manner as existing thermal products.

DESCRIPTION OF THE PREFERRED EMBODIMENT

Figure 1:
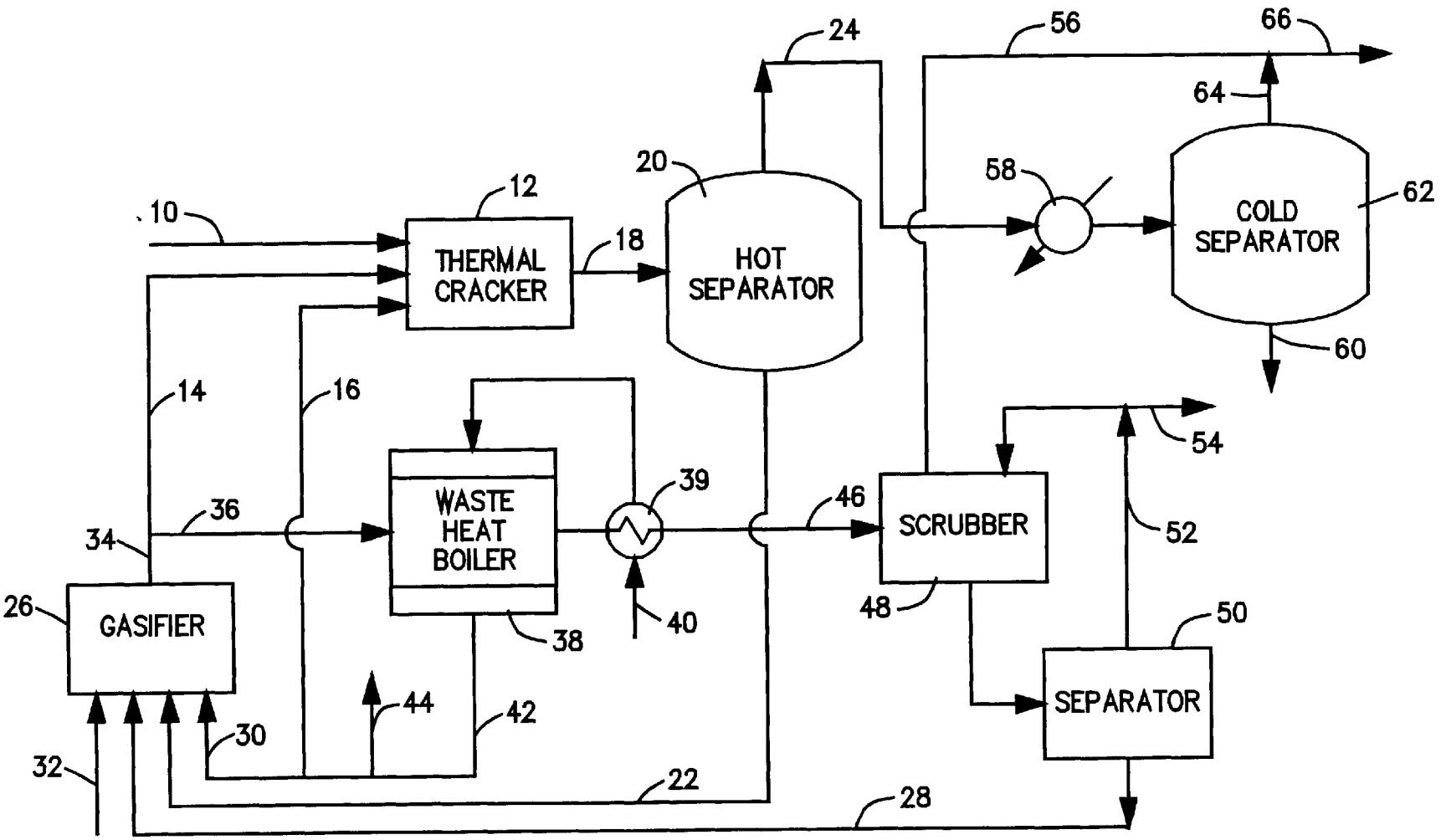
FIG. 1 is a block flow diagram of the process of the invention.

Referring to FIG. 1, a residue feed stream 10 from a refinery is fed to a contactor/thermal cracker 12 in which the feed 10 is contacted with a hot synthesis gas from a partial oxidation gasifier to be described later. The feed 10 can be any of the pumpable refinery residues previously mentioned such as a vacuum tower residue. Generally, such residue stream will have a boiling range above about 500° C. The sulfur content and the gravity are unimportant for the present invention. In the contactor/thermal cracker 12, the feed at about 150° C. is contacted with the synthesis gas 14 which is at about 1,250–1,500° C. The synthesis gas is quenched and the residue feed is heated and cracked to produce thermal distillates which are further processed in the refinery in the same manner as other thermal distillates. The presence of hydrogen and steam in the synthesis gas will suppress the formation of coke. However, high pressure steam 16 may be added to the contactor/thermal cracker 12 as needed to assist in the suppression of coke. The operating conditions in the contactor/thermal cracker 12 are in the range of 35–80 $kg/cm^2$ total pressure, 10–30 $kg/cm^2$ hydrogen partial pressure and 10–30 $kg/cm^2$ steam partial pressure. The conditions in the contactor/thermal cracker assuming a typical feed of vacuum tower residue are 70 $kg/cm^2$ total pressure, 25 $kg/cm^2$ hydrogen partial pressure and 10 $kg/cm^2$ steam partial pressure.

The effluent 18 from the contactor/thermal cracker 12 for a typical feed of vacuum tower residue would have, as an example, a composition comprising the bulk of the synthesis gas stream 14 plus the following components from the cracked residue feed:

| Component | Typical - Wt. % | Range - Wt. % |
|---|---|---|
| $H_2S$ | 1.5 | 1–2 |
| $C_1$ to $C_4$ | 6.8 | 5–8 |
| $C_5$ to 165° C. | 9.6 | 8–12 |
| 165 to 343° C. | 20.1 | 16–24 |
| 343 to 500° C. | 22.0 | 18–26 |
| 500° C. + | 40.0 | 52–28 |

The effluent 18 from the contactor/thermal cracker 12 has a temperature in the range of 500 to 550° C. The preferred temperature is selected to produce an effluent in which 50 to 70%, preferably about 60%, of the cracked residue are vapors at the effluent conditions and the remainder are liquids. This effluent 18 is fed to the hot separator 20 for separation of the hot liquid at 22 and the vapor at 24.

The hot liquid 22 from the separator 20, which is generally referred to as tar or pitch, is recycled to the gasifier 26 in which the pitch is converted to synthesis gas. The hot separator bottoms include most of the 500° C.+ material plus some of the 343/500° C. vacuum gas oil. In this example about 40% of the feed residue is obtained as hot separator bottoms.

Also fed to the gasifier 26 is recycle soot 28 to be described later, high pressure steam 30 and oxygen 32. The partial oxidation gasifier produces synthesis gas effluent 34 at 40–70 Kg/cm$^2$ containing hydrogen, carbon monoxide and dioxide, water and small amounts of hydrogen sulfide and other minor components. A typical gas composition from a high sulfur vacuum residue is as follows:

| Gas | Mole % |
|---|---|
| $H_2$ | 37.0 |
| CO | 39.0 |
| $CO_2$ | 7.0 |
| $H_2O$ | 14.0 |
| $H_2S$ | 1.5 |
| Other | 1.5 |

The temperature of the effluent 18 from the contactor/thermal cracker 12 and therefore the resulting temperature in the hot separator 20 are selected to produce a vapor-liquid separation in the hot separator to yield the desired amount of liquid 22 to recycle to the gasifier 26 for the production of the synthesis gas. Specific amounts will vary depending on the feed composition and the effluent temperature of the contactor. As an example for 100 metric tons (MT)/hr of residue feed 10, about 108 MT/hr of synthesis gas 34 is produced. This synthesis gas is then divided into streams 14 and 36 with about 50 MT/hr going at 14 to the contactor/thermal cracker 12. The synthesis gas rate is set by the amount of unconverted residue stream 22 coming from the hot separator as it must all be gasified. The synthesis gas rate is about 2.7 times the unconverted residue, although it will vary a small amount depending upon the feed residue composition. The amount of synthesis gas going to the contactor/thermal reactor will be about 0.5 times the feed residue. The ratio will depend upon the rate of conversion as follows:

| % Conversion | Syn Gas/Feed Ratio |
|---|---|
| 50 | 0.46 |
| 60 | 0.50 |
| 70 | 0.54 |

The amount of synthesis gas to the contactor/thermal reactor is what is needed to provide the heat for conversion. Any excess synthesis gas (stream 36) is cooled separately prior to gas scrubbing. Cooling can be via direct water quench or in a waste heat boiler as shown in FIG. 1. In this example, about 50 MT/hr is sent to the contactor/thermal reactor and 58 MT is sent to the waste heat boiler. To produce this amount of synthesis gas, about 40.0 MT/hr of tar/pitch residue 22 is required. The hot separator bottoms liquid 22 will contain most of the 500° C.+ material plus a portion of the 343–500° C. fraction. The hot separator does not provide perfect separation. Most of the 500° C.+ material goes with the bottom product, but some goes out with the vapor. Similarly, most of the 343–500° C. heavy gas oil goes out with the vapor, but some of it will go out with the bottoms product. The typical values and the ranges for the temperatures and flow rates for the relevant streams based on 60% conversion are as follows:

| Stream No. | T ° C. Range | Preferred T ° C. | MT/hr | Range |
|---|---|---|---|---|
| 10 | 150–250 | 150 | 100.0 | 100.0 |
| 34 | 1300–1400 | 1400* | 108.0 | 60–150 |
| 14 | 1300–1400 | 1400* | 50.0 | 40–60 |
| 36 | 1300–1400 | 1400* | 58.0 | 0–110 |
| 30 | 250–350 | 300 | 24.0 | 14–22 |
| 22 | 500–550 | 500** | 40.0 | 23–55 |
| 32 | 30–100 | 65 | 44.0 | 25–60 |
| 18 | 500–550 | 500** | 150.0 | 140–160 |

*The temperature will be between 1300–1400° C. depending on the feed composition. For lower temperatures, more synthesis gas is needed. This example is for 1400°.
**The preferred temperature is the temperature that results in the proper conversion. In this example, 500° C. and 40% conversion are used.

The divided synthesis gas stream 36 at about 1300–1400° C. passes to the waste heat boiler 38 and feed water heater 39 where the sensible heat is transferred from the synthesis gas to the boiler feedwater 40 to produce high pressure steam 42. The bulk of this high pressure steam can be added at 30 to the gasifier 26 as a component of the gasification or partial oxidation process. The required amount of steam 30 based on the preferred flow rates previously listed is about 24.0 MT/hr. A portion 16 of the remaining high pressure steam can be fed to the contactor/thermal cracker 12 as required for coke suppression. Any excess steam is fed at 44 for other desired uses. The cooled synthesis gas 46 now at about 180–250° C. is fed to an aqueous scrubber 48 where particulates such as soot are removed. The water and particulates are than separated at 50. The particulates can be recycled to the gasifier 26. The cleaned water is recycled at 52 to the scrubber and water which is accumulated is purged at 54. The remaining cooled and cleaned synthesis gas 56 from the scrubber 48 is combined with another synthesis gas stream preferably for power generation as will be explained later.

The hot vapor 24 from the hot separator 20 will contain the $H_2S$ and the cracked hydrocarbons. These hot vapors 24 are cooled at 58 to condense out the converted liquids 60 which are separated in the cold separator 62. For the specific example previously discussed, the converted liquids 60 will amount to about 50 MT/hr. Since there is no catalyst, the amount of hydrogen saturation is small. In practice, the cold separator 62 may be a fractionator which separates various fractions such as a naptha fraction, a light gas oil fraction and a heavy gas oil fraction. Depending upon the conversion and heat balances, a portion of the heavy gas oil fraction may be recycled to the partial oxidation unit. The remaining gas 64 is a synthesis-type gas which is combined with the synthesis gas 56 from the scrubber 48. The combined synthesis gas stream 66 of about 118 MT/hr is preferably fed to an acid gas scrubber to remove $H_2S$ and then fired in a gas turbine to generate power as shown in FIG. 2 described below.

Figure 2:
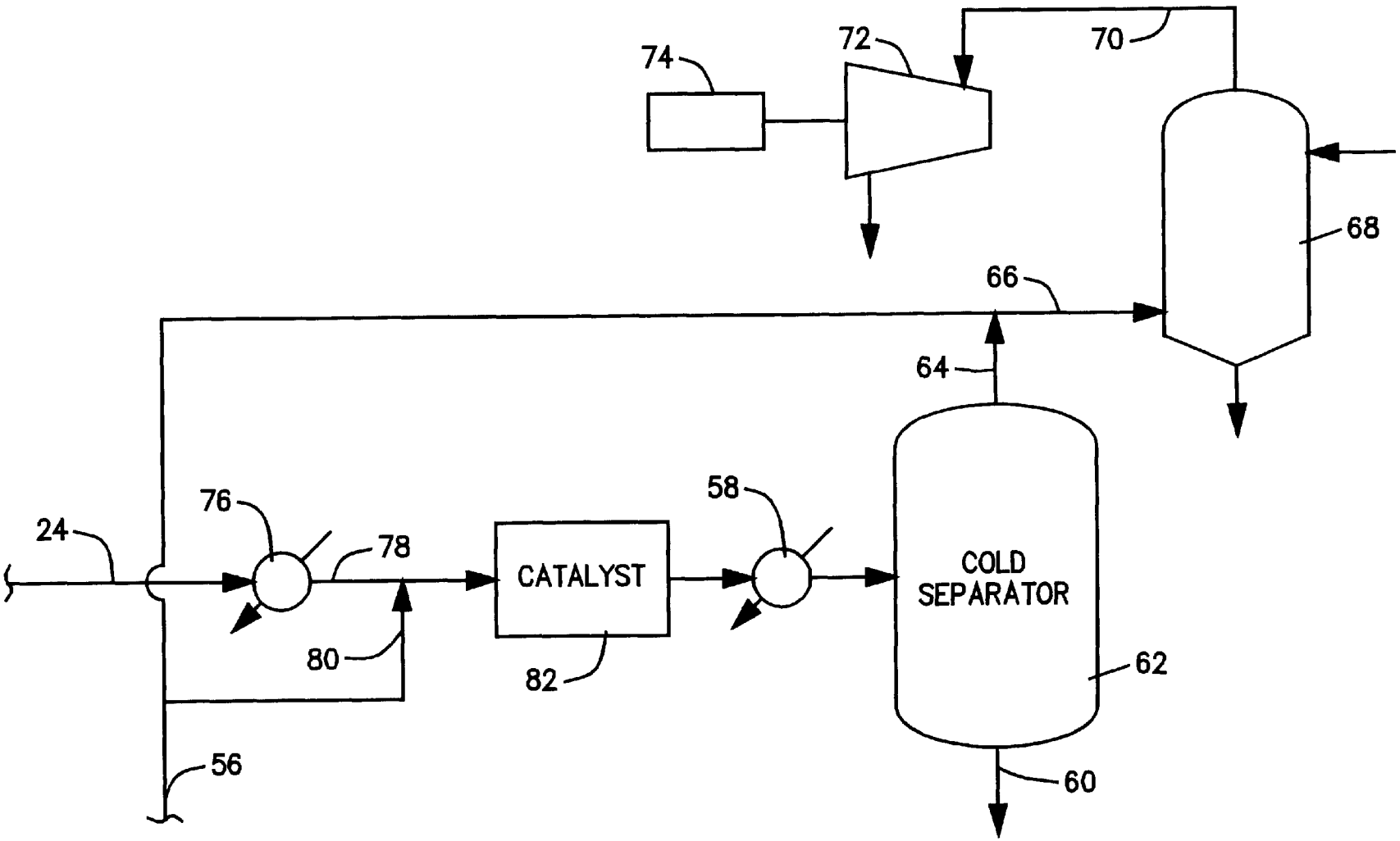
FIG. 2 is a block flow diagram showing a portion of the process incorporating a modification which incorporates hydrotreating of the thermal liquids within the process by utilizing the hydrogen contained in the synthesis gas.

FIG. 2 illustrates in block diagram form a modification of the present invention as well as the use of the product synthesis gas in a gas turbine as previously mentioned. Addressing this latter aspect of the invention first, the combined synthesis gas stream 66 is scrubbed at 68 to remove any sulfur containing acid gases such as $H_2S$. The cleaned gases 70 are then burned in the gas turbine 72 which powers the generator 74.

In the FIG. 2 embodiment, the hot vapor 24 from the hot separator 20 is cooled at 76 down to a temperature suitable for a catalytic hydrogenation reaction, about 350–400° C. This cooled vapor 78 may be mixed with any desired portion 80 of the cleaned synthesis gas 56 from the scrubber 48 for the catalytic hydrogenation reaction at 82. This catalytic reactor 82 can operate in a once-through manner since there is more than sufficient hydrogen in the vapors to hydrotreat the converted materials.

The cost of the contactor and the hot and cold separators for the invention would be significantly less than the cost of an equivalent visbreaker since the major cost of the visbreaker is the heater. No heater is required for the invention since the hot gases for the cracking are produced in the gasifier.

What is claimed is:

1. A method of processing a liquid residue stream from a petroleum refining process comprising the steps of:

a. thermal cracking said liquid residue feed stream comprising contacting said liquid residue feed stream with steam and hot synthesis gas containing hydrogen to cause said thermal cracking and producing a cracked residue stream comprising residue pitch liquid and a combined vapor containing cracked residue vapor and remaining synthesis gas, said thermal cracking being at a total pressure in the range of 35 to 80 $kg/cm^2$, a hydrogen partial pressure of 10 to 30 $kg/cm^2$ and a steam partial pressure of 10 to 30 $kg/cm^2$;

b. separating said residue pitch liquid from said combined vapor containing said cracked residue vapor and remaining synthesis gas;

c. partially oxidizing said residue pitch liquid while said residue pitch liquid is still hot and prior to any precipitation to produce a hot synthesis gas product stream;

d. supplying at least a portion of said hot synthesis gas product stream to step (a) as said hot synthesis gas; and e. cooling and separating said combined vapor containing said cracked residue vapor and remaining synthesis gas into a liquid product stream and a combustible vapor stream.

2. A method as recited in claim 1 wherein said liquid residue feed stream is at a temperature in the range of 150 to 250° C. and said hot synthesis gas is at a temperature in the range of 1250 to 1500° C. and said cracked residue stream is at a temperature in the range of 500 to 550° C.

3. A method as recited in claim 2 wherein the quantity of said hot synthesis gas is in the range of 40 to 100% by weight of said liquid residue feed stream.

4. A method as recited in claim 3 wherein the quantity of said residue pitch liquid is in the range of 20 to 60% by weight of said cracked residue steam.

5. A method as recited in claim 1 and further including the steps of extracting heat from another portion of said hot synthesis gas product stream and generating steam and supplying at least a portion of said steam to said step of thermal cracking.

6. A method as recited in claim 5 wherein another portion of said steam is supplied to said step of partially oxidizing.

7. A method as recited in claim 1 wherein said combustible vapor stream is burned in a gas turbine.

8. A method as recited in claim 1 wherein said combined vapor stream contains hydrogen and further including the step of contacting said combined vapor stream with a hydrogenation catalyst whereby said cracked residue vapor is hydrogenated.

9. A method as recited in claim 8 wherein said combined vapor stream is cooled to the range of 350 to 400° C. prior to contact with said hydrogenation catalyst.

* * * * *